US008230694B2

(12) United States Patent
Scarcella et al.

(10) Patent No.: US 8,230,694 B2
(45) Date of Patent: Jul. 31, 2012

(54) REFRIGERATION CIRCUIT

(75) Inventors: Jason Scarcella, Cicero, NY (US); William J. Heffron, Lafayette, NY (US)

(73) Assignee: Carrier Corporation, Farmington, CT (US)

( * ) Notice: Subject to any disclaimer, the term of this patent is extended or adjusted under 35 U.S.C. 154(b) by 633 days.

(21) Appl. No.: 12/445,411

(22) PCT Filed: Oct. 13, 2006

(86) PCT No.: PCT/US2006/040120

§ 371 (c)(1),
(2), (4) Date: Apr. 13, 2009

(87) PCT Pub. No.: WO2008/045086

PCT Pub. Date: Apr. 17, 2008

(65) Prior Publication Data

US 2010/0206002 A1 Aug. 19, 2010

(51) Int. Cl.
*F25B 45/00* (2006.01)

(52) U.S. Cl. ..... 62/292; 62/149

(58) Field of Classification Search ..... 62/85, 149, 62/292, 303, 475, 509
See application file for complete search history.

(56) References Cited

U.S. PATENT DOCUMENTS 4,624,112 A * 11/1986 Proctor ..... 62/149
4,646,527 A * 3/1987 Taylor ..... 62/85
4,663,725 A 5/1987 Truckenbrod et al.
4,735,059 A 4/1988 O'Neal
5,375,426 A 12/1994 Burgener
6,233,952 B1 5/2001 Porter et al.
6,619,057 B2 9/2003 Williamson et al.
7,000,415 B2 2/2006 Daddis, Jr. et al.

FOREIGN PATENT DOCUMENTS

CN 2036646 U 4/1989
CN 1172241 A 2/1998

OTHER PUBLICATIONS

English Translation of Chinese Office Action for Chinese Patent Application No. 200680056542.4 issuing date of Feb. 24, 2011.
S. Huan, "Refrigeration Principle and Device"[M]. BeiJing: China machine press, 1987, 2 pages.
English Translation of Chinese Office Action for Chinese Patent Application No. 200680056542.4 issuing date of Feb. 14, 2012, 12 pages.

* cited by examiner

*Primary Examiner* — Melvin Jones
(74) *Attorney, Agent, or Firm* — Cantor Colburn LLP

(57) ABSTRACT

A refrigeration circuit having a system charge and a system charge storage area. The system charge area has a condenser having a set of micro-channel heat exchanger coils. The condenser is appropriately sized to receive a first volume of the system charge. There is a compressor for compressing the system charge from an expanded state to a compressed state. There is a sealed refrigerant charge holding area fluidly connected to the condenser and the compressor. The sealed refrigerant charge holding area is appropriately sized for storing a second volume of the system charge during a system pumpdown. A receiver is fluidly connected to the sealed refrigerant charge holding area. The receiver is appropriately sized to receive a third volume of the system charge during a system pumpdown.

8 Claims, 1 Drawing Sheet

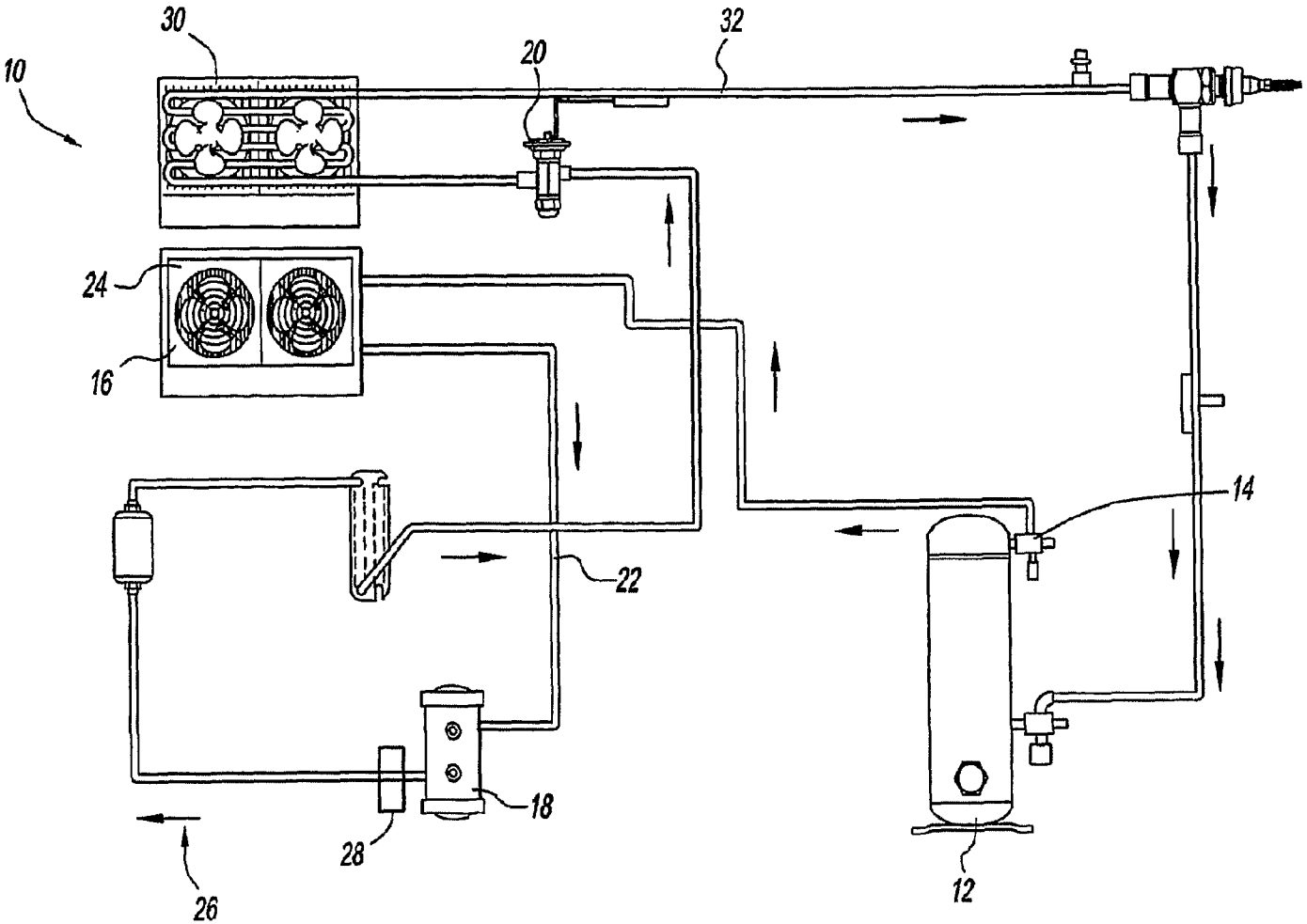
10
30
24
16
20
32
22
14
18
28
26
12

REFRIGERATION CIRCUIT

BACKGROUND OF THE INVENTION

1. Field of the Invention

The present disclosure is related to a refrigeration circuit. More particularly, the present disclosure is related to a refrigeration circuit having a sealed refrigerant charge holding area.

2. Description of Related Art

Refrigeration circuits are typically used in a number of devices in order to cool the temperature of ambient air. A typical refrigeration circuit contains at least a compressor, a condenser, a receiver, a series of valves, at least one evaporator, and a system charge which circulates throughout.

Periodically, various components of the circuit need to be serviced, repaired, and/or replaced. In order to do so, the system charge must be removed from the components that will need servicing. One method that is currently used to prepare the circuit for servicing is to drain all of the system charge from the circuit. The system charge can not be re-used and must be disposed of. Due to various environmental regulations, costs associated with the proper disposal of the spent system charge can be great. Therefore, this method may be undesirable.

A second method commonly used to prepare a circuit for servicing involves a "system pumpdown". In a system pumpdown, the compressor compresses all of the system charge which is then stored in a designated area within the circuit. This is advantageous in that it avoids having to remove and dispose of the system charge thereby, avoiding disposal costs and costs associated with new system charge.

In order for a system pumpdown to be effective, the designated storage area must have sufficient volume in which to store the compressed charge. Problems arise, however, when modifications to the circuit are made within the designated area, that reduce the volume available for storage. For example, in some refrigeration circuits, the condenser is included in the designated storage area. Round tube and fin condenser ("RTF") coils are frequently used in condensers. RTF coils have large internal volumes and provide sufficient space so that the compressed system charge can be stored within the storage area. However, when micro-channel heat exchanger ("MCHX") coils are substituted for the RTF coils, there is a reduction in storage volume. The heat transfer coefficient is higher for MCHX type construction than for RTF, so whenever this type of replacement is made for coils of equal capacity the internal volume (storage area) will be reduced. Problems will, therefore, arise during a system pumpdown as there is not sufficient space to store the compressed system charge.

There exists a need for a refrigeration circuit that can compensate for modifications made within the designated area that reduce the volume available for storage during a system pumpdown. Specifically, there exists a need for a refrigeration circuit that can compensate for the reduction in storage volume within a designated area when micro-channel heat exchanger coils are substituted for pre-existing coils within the condenser. The present disclosure provides such a circuit.

BRIEF SUMMARY OF THE INVENTION

It is an object of the present invention to provide a refrigeration circuit having a sealed refrigerant charge holding area.

These and other objects and advantages of the present invention are provided by a refrigeration circuit having a system charge and a system charge storage area. The system charge area has a condenser having a set of micro-channel heat exchanger coils. The condenser is appropriately sized to reject heat loads from external sources, ambient air, and air side heat sources such as evaporator motors and the compressor motor if it is inside the refrigeration circuit. Additionally, the condenser is appropriately sized to receive a first volume of the system charge. There is a compressor for compressing the system charge from an expanded state to a compressed state. There is a sealed refrigerant charge holding area fluidly connected to the condenser and the compressor. The sealed refrigerant charge holding area is appropriately sized for storing a second volume of the system charge during a system pumpdown. A receiver is fluidly connected to the sealed refrigerant charge holding area. The receiver is appropriately sized to receive a third volume of the system charge during a system pumpdown.

The above-described and other features and advantages of the present invention will be appreciated and understood by those skilled in the art from the following detailed description, drawings, and appended claims.

BRIEF DESCRIPTION OF THE SEVERAL VIEWS OF THE DRAWINGS

The FIGURE is a schematic representation of an exemplary embodiment of a refrigeration circuit according to the present disclosure.

DETAILED DESCRIPTION OF THE INVENTION

Referring to the drawings and in particular to the FIGURE, a refrigeration circuit 10 is generally illustrated. Advantageously, refrigeration circuit 10 contains a sealed refrigerant charge holding area, situated between the condenser and the receiver, that can be used to store system charge during a system pump down.

Refrigeration circuit 10 contains a compressor 12, a discharge service valve 14, a condenser 16, a receiver 18, a thermostatic expansion valve 20, a sealed refrigerant charge holding area 22, an evaporator 30, a high side service valve 28, and a system charge 32. Additionally, refrigeration circuit 10 has a direction of system charge flow 26.

It is contemplated by the present disclosure that compressor 12 may be any known type that allows refrigeration circuit 10 to operate as contemplated herein. For example, in one embodiment, when refrigeration circuit 10 is used in a transport refrigeration system Scroll Compressor RS105 manufactured by Scroll Technologies may be used.

Discharge service valve 14 is fluidly connected to compressor 12 and is positioned upstream in the direction of system charge flow 26. Discharge service valve 14 can be any known type suitable so that refrigeration circuit 10 can perform as contemplated herein. For example, in one embodiment, discharge service valve 14 may be selected from the group consisting of ball valves and compressor service valves.

Condenser 16 is situated upstream of discharge service valve 14 in direction of system charge flow 26. It is contemplated herein that condenser 16 can be any known type sufficient such that the condenser is suitable for the functioning of refrigeration circuit 10. For example, when refrigeration circuit 10 is used in a transport refrigeration system, a 7 millimeter round tube & fin condenser supplied by Carrier International Sdn Bhd (CISB) may be used. Additionally, condenser 16 contains a series of coils 24. The system charge flows through series of coils 24 and is cooled by an airstream that passes over the coils. It is contemplated in the present disclosure that series of coils 24 may be any type suitable such as to allow performance of refrigeration circuit 10. In one embodiment of the present disclosure, series of coils 24 are micro-channel heat exchanger coils.

Sealed refrigerant charge holding area 22 is fluidly connected to condensor 16 and receiver 18. In a preferred embodiment, sealed refrigerant charge holding area 22 is a pipe. The pipe may be made of metal, plastic, plastic composite, and any combination thereof. Additionally, sealed refrigerant charge holding area 22 has a diameter in the range of ⅝ inches to two inches, preferably 1¼", and any subranges there between. Additionally, sealed refrigerant charge holding area 22 has a length in the range of 6 inches to 60 inches, preferably 36 inches, and is angled on a downward slope from condenser 16 to receiver 18. In one embodiment, the downward slope has a minimum value of at least 2 degrees. If the minimum angle is not obtained, thermostatic expansion valve 20 can be starved of refrigerant. In another embodiment of the present disclosure, sealed refrigerant charge holding area 22 comprises at least one or more adapter pieces that mate sealed refrigerant charge holding area 22 to a pre-existing pipe-system.

Receiver 18 is fluidly connected to sealed refrigerant charge holding area 22. It is contemplated herein that receiver 18 can be any known type having properties that allow refrigeration circuit 10 to be operable. For example, when refrigeration circuit 10 is used in a refrigeration transport system, a 3 inch diameter all Copper pressure vessel manufactured by Spinco Metal Products Inc. can be used. In one embodiment of the present disclosure, high side service valve 28 may be situated downstream of receiver 18. High side service valve 28 may be any known valve suitable for use in refrigeration circuit 10.

Thermostatic expansion valve 20 is situated upstream of receiver 18. Thermostatic expansion valve 20 is any valve known in the art suitable for use in refrigeration circuit 10. For example, thermostatic expansion valve 20 may be an externally equalized expansion valve manufactured by Danfoss Refrigeration and Air Conditioning.

System charge 32 is any known type suitable for operation of refrigeration circuit 10. For example, in one embodiment of the present disclosure, system charge 32 is HFC-134a manufactured by Dupont.

During use, refrigeration circuit 10 operates in a known manner. For example, compressor 12 will receive a signal and begin compressing the system charge 32. System charge 32 subsequently flows through set of coils 24 in condenser 16. Condenser 16 contains a fan that blows an airstream over set of coils 24 thereby cooling system charge 32 that is flowing through the set of coils. System charge 32 then flows through receiver 18 and upstream in direction of charge flow 26 until it reaches thermostatic expansion valve 20. When thermostatic expansion valve 20 is closed, the cooled, compressed system charge 32 will collect until such time as thermostatic expansion valve 20 is opened. When thermostatic expansion valve 20 is opened, compressed system charge 32 expands and flows through evaporator 30 wherein heat is exchanged. System charge 32 then flows through to compressor 12 where it collects. When a signal is received by compressor 12, refrigeration circuit 10 starts again.

During a system pumpdown, high side service valve 28 is closed. A signal is then received by compressor 12 and the compressor is turned on. Compressor 12 then compresses essentially all of system charge 32. In one embodiment, after system charge 32 has been compressed, discharge service valve 14 is closed and system charge 32, in a compressed state, is contained between discharge service valve 14 and high side service valve 28. Service can then be performed on evaporators 30, thermostatic expansion valve 20, compressor 12 and any circuit parts therebetween.

In one embodiment of the present disclosure, refrigeration circuit 10 has condenser 16 having set of coils 24 in which micro-channel heat exchanger coils have been substituted for pre-existing RTF coils. Because micro-channel heat exchanger coils have a smaller storage volume than RTF coils for storing compressed system charge 32 during a system pumpdown, sealed refrigerant charge holding area 22 has been designed with dimensions to account for the reduction in storage volume of set of coils 24. By providing refrigerant charge holding area 22 having enlarged dimensions on 1¼"× 36", the additional volume of compressed system charge 32 can be stored.

Increasing the dimensions of sealed refrigerant charge holding area 22 is counterintuitive to standard practices in the refrigeration industry. Currently, manufacturers of refrigeration circuits design the circuits so that receiver 18 is always filled with system charge 32. There must always be system charge 32 in receiver 18 in order for the receiver to be operable. Thus, according to standard practices, refrigeration circuit 10 would be designed with a larger receiver with additional volume to store compressed system charge 32.

This would be problematic, however, because of increased expenses associated with the use of a larger receiver. The receiver would not only be more expensive, but there would also be increased engineering and design expenses. Additionally, a receiver of sufficiently large size may need to be treated as an ASME pressure vessel. As such, the receiver would be subject to numerous regulations also resulting in an increase expenses.

Although counterintuitive to standard practices, increasing the size of sealed refrigerant charge holding area 22 in refrigeration circuit 10, as contemplated in the present disclosure, allows for storage of compressed system charge 32 during system pumpdown. Additionally, by designing sealed refrigerant charge holding area 22 with a downward slope to receiver 18, this ensures that the receiver will always have system charge thereby rendering the refrigeration circuit operable.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A refrigeration circuit having a system charge and a system charge storage area, said system charge area comprising:

a condenser having a set of micro-channel heat exchanger coils, said condenser appropriately sized to receive a first volume of the system charge;

a compressor for compressing the system charge from an expanded state to a compressed state;

a sealed refrigerant charge holding area fluidly connected to said condenser and said compressor, said sealed refrigerant charge holding area appropriately sized for storing a second volume of the system charge during a system pumpdown; and a receiver fluidly connected to said sealed refrigerant charge holding area, said receiver appropriately sized to receive a third volume of the system charge during a system pumpdown;

wherein the sealed refrigerant charge holding area is positioned on a downward slope from the condenser to the receiver.

2. The refrigeration circuit of claim 1, wherein said sealed refrigerant charge holding area is a pipe.

3. The refrigeration circuit of claim 2, wherein said pipe is selected from the group consisting of metal, plastic, plastic composite, and any combination thereof.

4. A refrigeration circuit having a system charge and a system charge storage area, said system charge area comprising:

a condenser having a set of micro-channel heat exchanger coils, said condenser appropriately sized to receive a first volume of the system charge;

a compressor for compressing the system charge from an expanded state to a compressed state;

a sealed refrigerant charge holding area fluidly connected to said condenser and said compressor, said sealed refrigerant charge holding appropriately sized for storing a second volume of the system charge during a system pumpdown; and a receiver fluidly connected to said sealed refrigerant charge holding area, said receiver appropriately sized to receive a third volume of the system charge during a system pumpdown;

wherein said sealed refrigerant charge holding area has a diameter of between ⅝ inch and 2 inches.

5. A refrigeration circuit having a system charge and a system charge storage area, said system charge area comprising:

a condenser having a set of micro-channel heat exchanger coils, said condenser appropriately sized to receive a first volume of the system charge;

a compressor for compressing the system charge from an expanded state to a compressed state;

a sealed refrigerant charge holding area fluidly connected to said condenser and said compressor, said sealed refrigerant charge holding area appropriately sized for storing a second volume of the system charge during a system pumpdown; and a receiver fluidly connected to said sealed refrigerant charge holding area, said receiver appropriately sized to receive a third volume of the system charge during a system pumpdown;

wherein said sealed refrigerant charge holding area has a length in the range of 6 inches to 60 inches.

6. A refrigeration circuit having a system charge and a system charge storage area, said system charge area comprising:

a condenser having a set of micro-channel heat exchanger coils said condenser appropriately sized to receive a first volume of the system charge;

a compressor for compressing the system charge from an expanded state to a compressed state;

a sealed refrigerant charge holding area fluidly connected to said condenser and said compressor, said sealed refrigerant charge holding area appropriately sized for storing a second volume of the system charge during a system pumpdown;

a receiver fluidly connected to said sealed refrigerant charge holding area, said receiver appropriately sized to receive a third volume of the system charge during a system pumpdown; and an evaporator fluidly connected to said condenser, wherein a heat transfer between the system charge and ambient air occurs.

7. The refrigeration circuit of claim 6, further comprising a thermostatic expansion valve fluidly connected to said evaporator, said thermostatic expansion valve regulating the flow of the system charge throughout the refrigeration circuit.

8. A refrigeration circuit having a system charge and a system charge storage area, said system charge area comprising:

a condenser having a set of micro-channel heat exchanger coils, said condenser appropriately sized to receive a first volume of the system charge;

a compressor for compressing the system charge from an expanded state to a compressed state;

a sealed refrigerant charge holding area fluidly connected to said condenser and said compressor, said sealed refrigerant charge holding area appropriately sized for storing a second volume of the system charge during a system pumpdown;

a receiver fluidly connected to said sealed refrigerant charge holding area, said receiver appropriately sized to receive a third volume of the system charge during a system pumpdown; and a high side service valve located upstream and fluidly connected to said receiver, said high side service valve for regulating the flow of the system charge throughout the refrigeration circuit.

* * * * *